US007131822B2

(12) United States Patent
Shiina

(10) Patent No.: US 7,131,822 B2
(45) Date of Patent: Nov. 7, 2006

(54) SWASH PLATE COMPRESSORS WITH NON-CIRCULAR PISTONS AND CYLINDERS

(75) Inventor: Masaki Shiina, Maebashi (JP)

(73) Assignee: Sanden Corporation, Gunma (JP)

( * ) Notice: Subject to any disclaimer, the term of this patent is extended or adjusted under 35 U.S.C. 154(b) by 311 days.

(21) Appl. No.: 10/721,326

(22) Filed: Nov. 26, 2003

(65) Prior Publication Data

US 2004/0103778 A1 Jun. 3, 2004

(30) Foreign Application Priority Data

Nov. 26, 2002 (JP) ..... 2002-342546

(51) Int. Cl.
*F04B 1/12* (2006.01)
*F04B 27/08* (2006.01)

(52) U.S. Cl. ..... 417/269; 92/177; 92/165 R

(58) Field of Classification Search ..... 92/71 X, 92/165 PR, 169.1, 177 X, 71, 165 R, 177; 417/269, 222.1
See application file for complete search history.

(56) References Cited

U.S. PATENT DOCUMENTS 1,436,177 A * 11/1922 Krause ..... 92/177
4,790,727 A * 12/1988 Steele ..... 417/269
5,013,219 A * 5/1991 Hicks et al. ..... 417/269
5,211,101 A * 5/1993 Letsch et al. ..... 92/177
5,380,166 A * 1/1995 Terauchi ..... 417/269
5,421,243 A * 6/1995 Burkett et al. ..... 92/177
5,868,556 A * 2/1999 Umemura ..... 417/269
6,158,974 A * 12/2000 Tarutani et al. ..... 417/269
6,332,394 B1 * 12/2001 Kato et al. ..... 92/71
6,393,964 B1 * 5/2002 Katayama et al. ..... 92/71
6,484,621 B1 * 11/2002 Kato et al. ..... 92/71
6,513,417 B1 * 2/2003 Sugiura et al. ..... 92/71
6,557,454 B1 * 5/2003 Miyazawa ..... 92/71
6,739,236 B1 * 5/2004 Kato et al. ..... 92/71
2003/0066419 A1 * 4/2003 Kato et al. ..... 92/71
2003/0121413 A1 * 7/2003 Pitla et al. ..... 92/71
2005/0025648 A1 * 2/2005 Shimizu et al. ..... 417/521

FOREIGN PATENT DOCUMENTS

JP 06159238 6/1994

* cited by examiner

*Primary Examiner*—William H. Rodriguez
(74) *Attorney, Agent, or Firm*—Baker Botts L.L.P.

(57) ABSTRACT

A swash plate compressor comprises a swash plate located for rotation in a housing and a compression unit that forms a part of the housing. The compression unit has cylinder bores that guide pistons in reciprocation as the swash plate rotates. Each cylinder bore has a cross section formed of any other closed curve than a circle. The closed curve is defined by curve elements and straight elements.

13 Claims, 5 Drawing Sheets

SWASH PLATE COMPRESSORS WITH NON-CIRCULAR PISTONS AND CYLINDERS

This nonprovisional application claims priority under 35 U.S.C. 119(a) on Paten Application No.2002-342546 filed in Japan on Nov. 26, 2002, the entire contents of which are hereby incorporated by reference.

BACKGROUND OF THE INVENTION

1. Field of the Invention

The present invention relates to a swash plate compressor adapted for use in a refrigerating system.

2. Description of the Related Art

A swash plate compressor of this type is described in Jpn. Pat. Appln. KOKAI Publication No. 6-159238, for example. This conventional compressor is provided with a rotatable main shaft, on which a swash plate is mounted. The swash plate rotates together with the main shaft in one direction. The rotation of the swash plate causes pistons in cylinder bores to reciprocate.

The cross section of each cylinder bore is not in the shape of a perfect circle, and has the shape of a closed curve that is formed of a plurality of curve elements smoothly connected to each other. The curve elements have their respective curvature radii.

According to the compressor described above, the cross section of each cylinder bore is not in the shape of a perfect circle, so that each piston cannot rotate around its own axis, that is, its rotation is favorably prevented by the cylinder bore.

Since the cross-sectional shape of each cylinder bore is complicated, however, it is very hard to work the bore.

SUMMARY OF THE INVENTION

The object of the present invention is to provide a swash plate compressor in which pistons can be prevented from rotating around their respective axes in cylinder bores and of which the cylinder bores can be worked with ease.

The above object is achieved by a swash plate compressor according to the present invention. The compressor comprises a housing; a rotatable main shaft extending in the housing; a swash plate mounted on the shaft and rotatable together with the shaft; and a compressor unit adapted to carry out a suction process and a compression process for a working fluid as the swash plate rotates. The compressor unit includes a plurality of pistons arranged adjacent to one another in the rotating direction of the swash plate and adapted to reciprocate in the axial direction of the shaft as the swash plate rotates, and a plurality of cylinder bores capable of individually receiving the corresponding pistons and guiding the pistons in reciprocation. Each of the cylinder bores has a cross section formed of any other closed curve than a circle. The closed curve includes curve elements and straight elements, each of the straight elements connecting each two adjacent curve elements.

According to the compressor described above, the cross section of each cylinder bore is not circular, so that the cylinder bore prevents the piston from rotating around its own axis. Since the closed curve that defines the cross section of the cylinder bore includes the straight elements, the cylinder bore can be worked more easily than a cylinder bore that is defined by a closed curve formed of curve elements only.

More specifically, the closed curve that defines the cross section of the cylinder bore may be substantially triangular or oval. If the closed curve is thus substantially triangular or oval, the cylinder bores can be arranged closely in the compressor unit. Therefore, the occupancy of the sum of the respective cross sections of the cylinder bores in the cross section of the compressor unit can be increased, so that the compressor can be increased in capacity or downsized.

If the closed curve is substantially oval, a large end portion of the closed curve should preferably be situated ahead as viewed in the rotating direction of the swash plate. In this case, a great force of pressure or side force from each piston that acts on the inner peripheral surface of each cylinder bore is received by a wide area of the inner peripheral surface of the cylinder bore. Thus, surface pressure that acts on the inner peripheral surface of the cylinder bore can be lowered.

The compressor unit includes a cylindrical outer shell, a metallic center sleeve located in the center of the outer shell, metallic intermediate sleeves arranged between the center sleeve and the outer shell and individually defining the cylinder bores therein, and a synthetic resin filler filling gaps in the outer shell.

The compressor unit constructed in this manner is so light in weight that it is highly conducive to the reduction of the gross weight of the compressor. Further, the cylinder bores having the aforesaid cross section can be easily obtained by plastically deforming the intermediate sleeves.

On the other hand, the piston may include a piston head and a piston ring. Only the piston head and the piston ring are in sliding contact with the inner peripheral surface of the cylinder bore. In this case, only the piston head and the piston ring are expected to have a cross section that matches the cross section of the cylinder bore, so that the piston can be worked with ease.

More specifically, the piston head and the piston ring each include a metallic ring portion and a seal ring surrounding the outer periphery of the ring portion. The seal ring is formed of a synthetic resin and elastically deformable.

If the working accuracy of the ring portion is relatively poor, in this case, the piston head and the piston ring can be brought easily and securely into intimate contact with the inner peripheral surface of the cylinder bore.

Further, the ring portion and/or the seal ring may have a slit. This slit guides some of the working fluid into a swash plate chamber in the housing. If the working fluid contains a mist of lubricating oil, the fluid introduced into the swash plate chamber can serve for the lubrication of bearings that support the main shaft for rotation.

The seal ring may have at least one circumferential groove on its outer peripheral surface. This circumferential groove facilitates elastic deformation of the outer peripheral surface of the seal ring, so that the closeness of contact of the piston head and the piston ring with the inner peripheral surface of the cylinder bore can be further improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
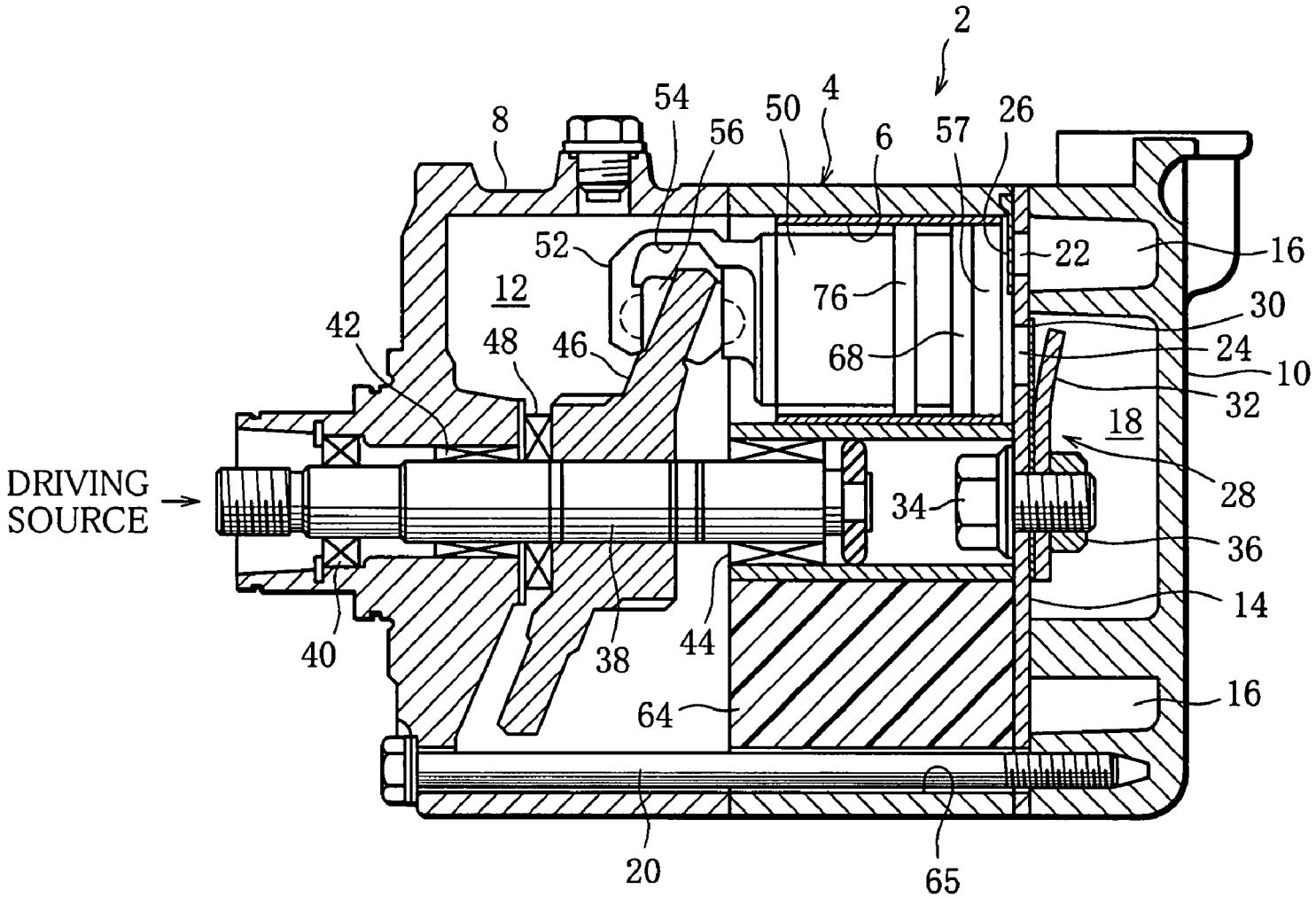
FIG. 1 is a sectional view of a swash plate compressor according to one embodiment of invention taken along line I—I of FIG. 2.

Referring to FIG. 1, there is shown a swash plate compressor, which comprises a housing 2. The housing 2 includes a cylindrical compressor unit 4. The compressor unit 4 has a plurality of cylinder bores 6, which penetrate the unit 4 in its axial direction and adjoin one another in the circumferential direction of the unit 4.

A front casing 8 and a rear casing 10 are arranged individually on the opposite sides of the compressor unit 4. The front casing 8 defines therein a swash plate chamber or a crank chamber 12 in conjunction with one end face of the compressor unit 4.

A valve plate 14 is interposed between the other end face of the compressor unit 4 and the rear casing 10. The rear casing 10 defines therein a suction chamber 16 and a discharge chamber 18 in conjunction with the valve plate 14.

The compressor unit 4, casings 8 and 10, and valve plate 14 are coupled to one another by means of a plurality of connecting bolts 20 and form the housing 2.

The suction chamber 16 and the discharge chamber 18 are defined independently of each other. The discharge chamber 18 is located in the center of the rear casing 10, while the suction chamber 16 is located surrounding the discharge chamber 18.

If the compressor of the present embodiment is incorporated in a refrigerating circuit, the suction chamber 16 and the discharge chamber 18 are connected to an evaporator and a condenser, respectively. The evaporator and the condenser are not shown in FIG. 1.

The valve plate 14 has suction ports 22 and discharge ports 24 corresponding to the cylinder bores 6, individually. The ports 22 and 24 internally connect their corresponding cylinder bores 6 to the suction chamber 16 and the discharge chamber 18.

Corresponding individually to the cylinder bores 6, moreover, suction valves 26 are arranged on one end face of the valve plate 14 on the compressor unit side. The suction valves 26 can individually open and close the respective suction ports 22 of their corresponding cylinder bores 6. More specifically, each suction valve 26 has a reed-shaped valve body, of which the basal part is held between the compressor unit 4 and the valve plate 14.

Corresponding individually to the cylinder bores 6, on the other hand, discharge valves 28 are arranged on the other end face of the valve plate 14. The discharge valves 28 individually open and close the respective discharge ports 24 of their corresponding cylinder bores 6. More specifically, each discharge valve 28 has a reed-shaped valve body 30 and a stopper 32 that regulates the opening of the valve body 30. The valve body 30 and the stopper 32 are mounted on the valve plate 14 by means of a bolt 34 and a nut 36.

In the crank chamber 12, a main shaft 38 is located coaxially with the compressor unit 4. One end of the shaft 38 penetrates the end wall of the front casing 8 and projects outward from the casing 8. It is rotatably supported on the front casing 8 by means of bearings 40 and 42. The other end of the shaft 38 is inserted in the compressor unit 4 and rotatably supported on the compressor unit 4 by means of a bearing 44. The one end of the shaft 38 is connected to a drive source, which rotates the shaft 38 in one direction.

A swash plate 46 is located in the crank chamber 12. The swash plate 46 is mounted on the shaft 38 and supported on the end wall of the front casing 8 by means of a thrust bearing 48. If the shaft 38 is rotated, therefore, the swash plate 46 also rotates together with the shaft 38. The rotation of the swash plate 46 causes pistons 50, which are inserted individually in the cylinder bores 6 of the compressor unit 4, to reciprocate.

More specifically, each piston 50 has a tail 52 on one end on the crank chamber side. The tail 52 is formed integrally with the piston 50 and projects into the crank chamber 12 through its corresponding cylinder bore 6. The tail 52 has a groove 54, which opens inward in the diametrical direction of the swash plate 46 and penetrates the tail 52 in the circumferential direction of the swash plate 46. Thus, the groove 54 has inner walls that face each other in the axial direction of the piston 50. A pair of shoes 56 are mounted on these inner walls, individually. The shoes 56 hold the outer peripheral portion of the swash plate 46 between them. The swash plate 46 rotates in sliding contact with the shoes 56. More specifically, the shoes 56 are supported on the inner walls of the groove 54 by means of spherical bearings.

In each cylinder bore 6, on the other hand, a compression chamber 57 is defined between the other end of the piston 50 and the valve plate 14. When the suction valve 26 is opened, the compression chamber 57 communicates with the suction chamber 16. On the other hand, the compression chamber 57 communicates with the discharge chamber 18 when the discharge valve 28 is opened.

Figure 2:
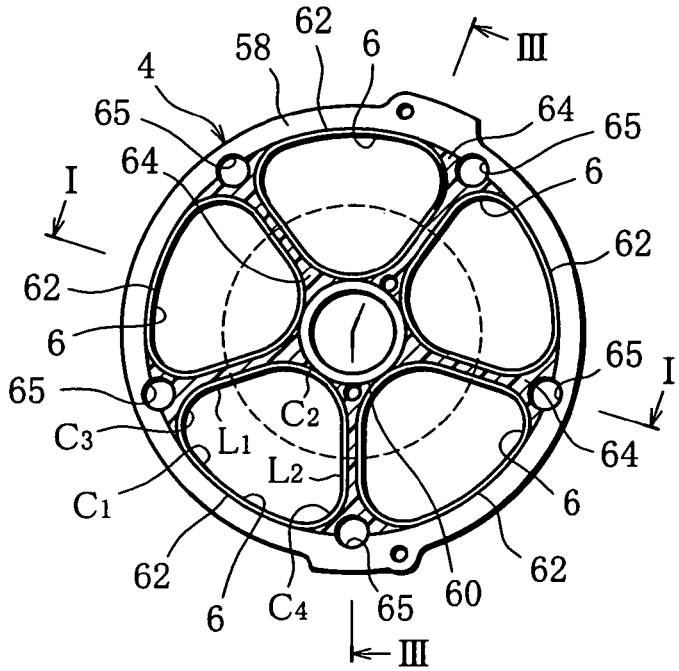
FIG. 2 is an end view of a compressor unit shown in FIG. 1.
Figure 3:
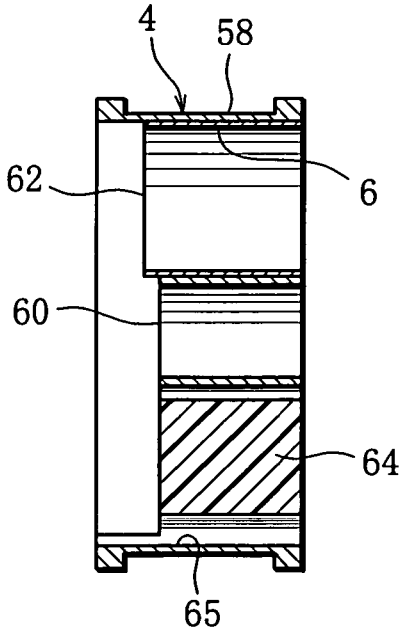
FIG. 3 is a sectional view taken along line III—III of FIG. 2.

The internal structure of the compressor unit 4 can be understood more easily with reference to FIGS. 2 and 3. The compressor unit 4 has a cylindrical outer shell 58, and a center sleeve 60 is located in the outer shell 58. The center sleeve 60 is situated in the center of the outer shell 58 and supports the other end of the shaft 38 by means of the bearing 44. The head of the bolt 34 for the discharge valve 28 is located in the center sleeve 60.

Six intermediate sleeves 62 are arranged between the center sleeve 60 and the outer shell 58. The intermediate sleeves 62 adjoin one another in the circumferential direction of the center sleeve 60 and define therein the cylinder bores 6, individually.

In the outer shell 58, moreover, gaps outside the sleeves 60 and 62 are filled with a filler 64. Further, passage holes 65 for the connecting bolts 20 are defined between the inner peripheral surface of the outer shell 58 and the filler 64.

As seen from FIG. 2, the cross section of each intermediate sleeve 62 or each cylinder bore 6 is not in the shape of a perfect circle but substantially triangular. The triangular cross section has a base that extends along the inner peripheral surface of the outer shell 58.

More specifically, the cross section of each cylinder bore 6 has the shape of a closed curve that is formed of four curve elements $C_1$ to $C_4$ and two straight elements $L_1$ and $L_2$, for example. The curve element $C_1$ has a curvature radius $R_1$ that extends along the inner peripheral surface of the outer shell 58, while the curve element $C_2$ has a curvature radius $R_2$ that extends in point contact with the outer peripheral surface of the center sleeve 60. The radius $R_1$ is longer than the radius $R_2$. The curve elements $C_3$ and $C_4$ smoothly connect with the opposite end of the curve element $C_1$, and have a curvature radius $R_3$ that is smaller than the curvature radius $R_2$. Further, the straight element $L_1$ connects the curve elements $C_2$ and $C_3$, while the straight element $L_2$ connects the curve elements $C_2$ and $C_4$.

The intermediate sleeves 62, which have the aforesaid cross section, can be obtained by plastically deforming a tube having a cross section in the shape of a perfect circle by hydroforming, for example.

Figure 4:
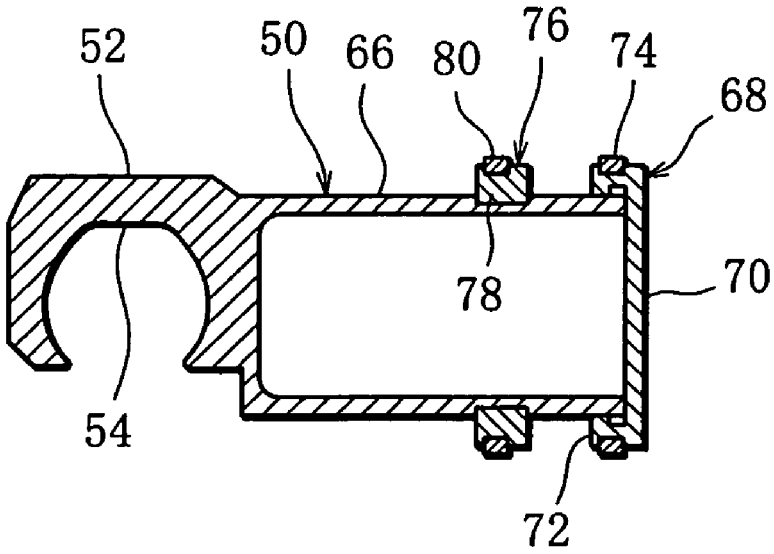
FIG. 4 is a profile of a piston shown in FIG. 1.
Figure 5:
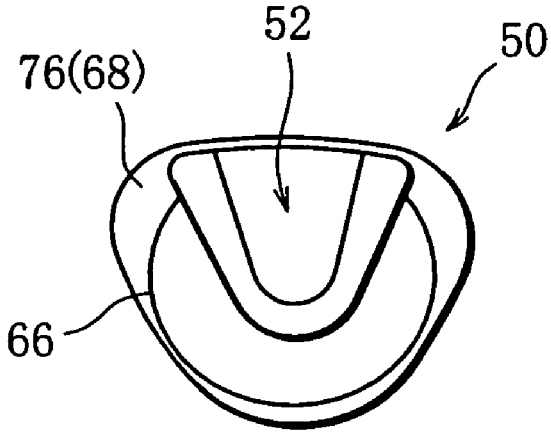
FIG. 5 is an end view of the piston of FIG. 4 taken from the tail side.

FIGS. 4 and 5 show the piston 50 in detail.

The piston 50 includes a piston body 66 having the aforesaid tail 52 on one end. The piston body 66 is in the shape of a hollow cylinder having the other end open. A piston head 68 is mounted on the other end of the piston body 66. The piston head 68 has an outside diameter greater than that of the piston body 66 and closes the other end of the body 66.

More specifically, the piston head 68 includes a metallic end cap 70 that closes the other end of the piston body 66. The end cap 70 has a rim 72 that surrounds the outer peripheral surface of the other end of the piston body 66. A seal ring 74 is mounted on the outer periphery of the rim 72. The seal ring 74 is formed of a synthetic resin and is elastically deformable.

Further, the piston body 66 is fitted with a piston ring 76 that is situated close to the piston head 68. The ring 76 has a metallic ring body 78 that surrounds the outer peripheral surface of the piston body 66 and a seal ring 80 that is mounted on the outer periphery of the body 78. The seal ring 80 is also formed of a synthetic resin and is elastically deformable.

As seen from FIG. 5, the piston head 68 and the piston ring 76 of the piston 50 has the same external shape as the cross section of the cylinder bore 6, and can be fitted in the bore 6 in an airtight manner.

Figure 6:
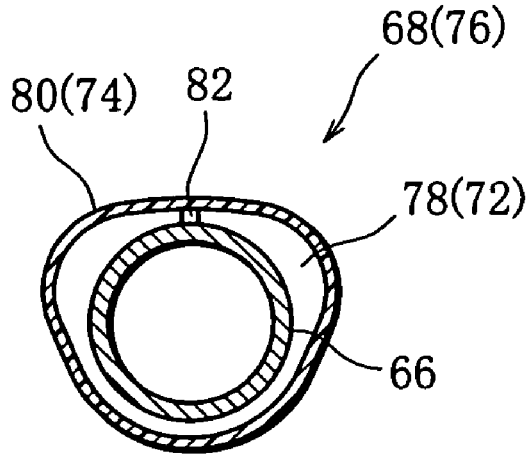
FIG. 6 is a cross-sectional view of the piston of FIG. 4.

As shown in FIG. 6, slits 82 are formed individually in the rim 74 of the piston head 68 and the ring body 78 of the piston ring 76. The slits 82 extend in the axial direction of the piston 50 and divide the rim 74 and the ring body 78, individually.

Figure 7:
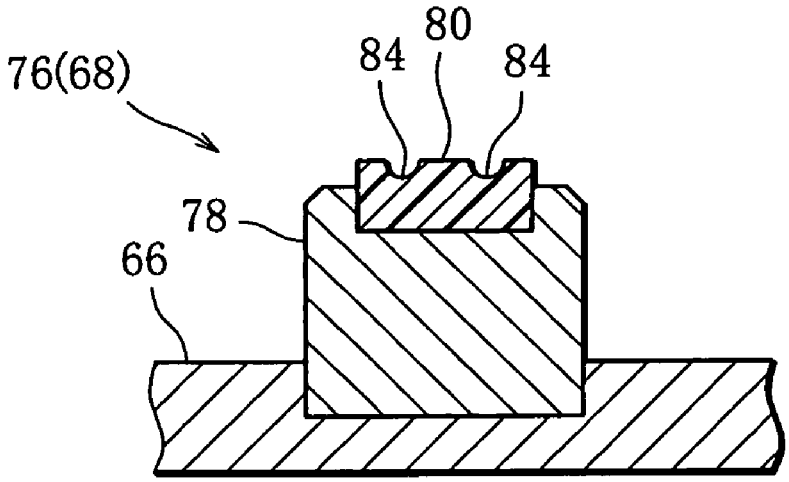
FIG. 7 is an enlarged view showing a part of FIG. 4.

As shown in FIG. 7, two circumferential grooves 84 are formed on the outer peripheral surface of the seal ring 80. Two circumferential grooves (not shown) that resemble the grooves 84 are also formed on the seal ring 74. The number of circumferential grooves 84 is not limited to two and may alternatively be one or three or more.

When the main shaft 38 is rotated in the compressor described above, the swash plate 46 is rotated in sliding contact with the paired shoes 56 of the pistons 50. This rotation of the swash plate 46 causes the pistons 50 to reciprocate in their corresponding cylinder bores 6.

When each piston 50 is moved away from the suction valve 26, the valve 26 allows the suction port 22 to open, whereupon a refrigerating gas flows into the compression chamber 57 through the port 22. When the piston 50 is moved toward the discharge valve 28, thereafter, the suction valve 26 closes the suction port 22 under the pressure in the compression chamber 57. Thereupon, the refrigerating gas in the compression chamber 57 is compressed.

When the pressure of the refrigerating gas overcomes the closing force of the discharge valve 28, valve 28 allows the discharge port 24 to open, whereupon the compressed refrigerating gas in the compression chamber 57 is discharged into the discharge chamber 18 through the discharge port 24.

The rotation of the swash plate 46 not only urges each piston 50 to reciprocate but also urges the piston 50 to rotate around its axis. Since the cylinder bore 6 of the piston 50 has the cross section not in the shape of a perfect circle, as mentioned before, however, the piston 50 can never rotate around its axis. In consequence, the paired shoes 56 of the piston 50 can smoothly guides the swash plate 46 in rotation.

The closed curve that defines the cross section of each cylinder bore 6 partially includes the straight elements. Therefore, each cylinder bore 6 or each intermediate sleeve 62, compared with a cylinder bore that is defined by a closed curve formed of curve elements only, can be worked more easily.

As mentioned before, each cylinder bore 6 is substantially triangular and has the base that extends along the inner peripheral surface of the outer shell 58. Therefore, the area of the filler 64 on the plane of the cross section of the outer shell 58 can be reduced. This implies that the area of the cross section of each cylinder bore 6 on the plane of the cross section of the outer shell 58 increases. If the cross section of the outer shell 58 is fixed, therefore, the capacity of the compressor can be increased. If the capacity of the compressor is fixed, on the other hand, the compressor can be downsized.

Each cylinder bore 6 is formed of the intermediate sleeve 62, and the outer shell 58 is filled with the filler 64. Accordingly, the compressor unit 4 can be reduced in weight.

Since the cross section that is required by each cylinder bore 6 can be obtained by plastically deforming the intermediate sleeve 62, the bore 6 can be formed with ease.

As mentioned before, each piston 50 includes the piston head 68 and the piston ring 76 that are greater in diameter than its piston body 66. Therefore, only the head 68 and the ring 76 can be in sliding contact with the inner peripheral surface of the cylinder bore 6. Thus, only the head 68 and the ring 76 are expected to have the cross-sectional shape that matches the cross section of the cylinder bore 6, so that the piston 50 can be obtained with ease.

The piston head 68 and the piston ring 76 have their respective seal rings 74 and 80 of a resin that are elastically deformable. Therefore, the nd cap 70 of the piston head 68 and the ring body 78 of the piston ring 76 never require high working accuracy. If the working accuracy of the cap 70 and the ring body 78 is low, therefore, the seal rings 74 and 80 can be satisfactorily brought into intimate contact with the inner peripheral surface of the cylinder bore 6. Since each of the seal rings 74 and 80 has the two circumferential grooves 84, moreover, its outer peripheral surface is liable to elastic deformation and can enjoy highly intimate contact with the inner peripheral surface of the cylinder bore 6.

In consequence, the pistons 50 that are fitted individually in the cylinder bores 6 can be obtained with ease, so that the productivity of the compressor can be improved.

Since the rim 72 of the end cap 70 and the ring body 78 have their respective slits 82, moreover, some of the refrigerating gas in the compression chamber 57 flows into the crank chamber 12. Since the refrigerating gas that is applied to the refrigerating circuit contains a mist of lubricating oil, the gas introduced into the crank chamber 12 can be utilized for the lubrication of the bearings 42, 44 and 48.

The present invention is not limited to the embodiment described above and various changes and modifications may be effected therein.

Figure 8:
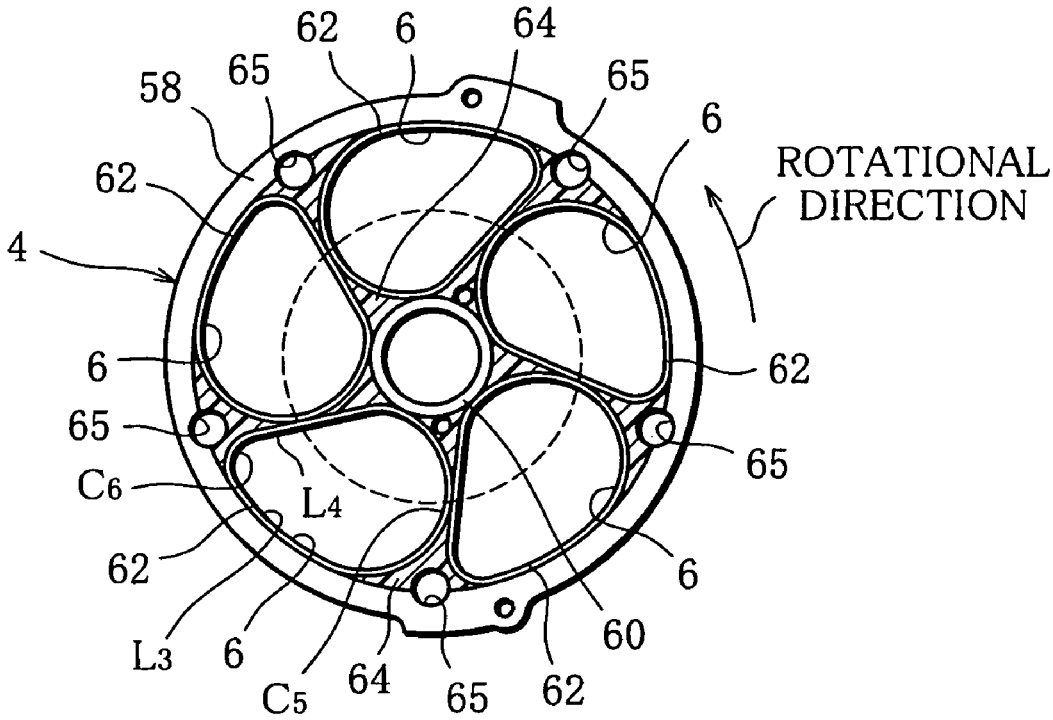
FIG. 8 is an end view of a modification of the compressor unit.

For example, the compressor unit 4 may comprise a plurality of cylinder bores 6 such as the ones shown in FIG. 8. These bores 6 have an oval cross section.

More specifically, a closed curve that defines the oval cross section includes curve elements $C_5$ and $C_6$, which are spaced in the rotating direction of the swash plate 46 indicated by the arrow in FIG. 8, and two straight elements $L_3$ and $L_4$ that connect the curve elements $C_5$ and $C_6$. The curve element $C_5$ has a curvature radius greater than that of the curve element $C_6$, and is situated ahead of the element $C_6$ as viewed in the rotating direction of the swash plate 46. Thus, the cylinder bore 6 has large and small end portions on the plane of its cross section. The large end portion is situated ahead of the small end portion as viewed in the rotating direction of the swash plate 46.

When each piston 50 reciprocates in the aforesaid manner as the swash plate 46 rotates, the piston 50 is pressed forward against the inner peripheral surface of its corresponding cylinder bore 6 with respect to the rotating direction of the swash plate 46. The force of this press is called side force. This side force is greater when the piston 50 is in its compression stroke than when the piston is in its suction stroke.

As mentioned before, however, the cross section of the cylinder bore 6 has the large end portion $C_5$ in its forward part with respect to the rotating direction of the swash plate 46. The large end portion $C_5$ can support each piston 50 with a wide contact area. Thus, surface pressure from the piston 50 that acts on the large end portion $C_5$ is lowered, so that smooth reciprocation of the piston 50 can be ensured.

Figure 9:
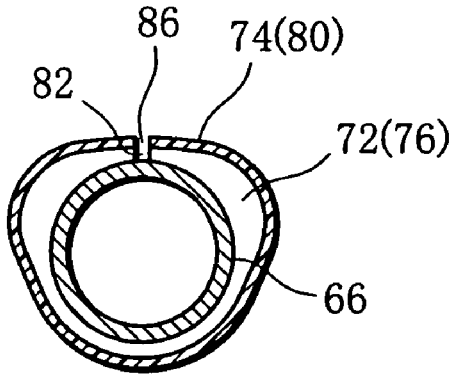
FIG. 9 is a cross-sectional view of a modification of the piston.

As shown in FIG. 9, furthermore, the seal rings 74 and 80 may also have their respective slits 86. The slits 86, in conjunction with their corresponding slits 82, form passages for the refrigerating gas and promote the flow of refrigerating gas from the compression chamber 57 into the swash plate chamber 12.

What is claimed is:

1. A swash plate compressor, comprising:

a housing;

a rotatable main shaft extending in the housing;

a swash plate mounted on the shaft and rotatable together with the shaft; and a compressor unit adapted to carry out a suction process and a compression process for a working fluid as the swash plate rotates, wherein the compressor unit comprises:

a plurality of pistons arranged adjacent to one another in the rotating direction of the swash plate and adapted to reciprocate in an axial direction of the shaft as the swash plate rotates; and a plurality of cylinder bores, wherein each of the cylinder bores is configured to receive a corresponding one of the pistons and to guide the corresponding one of the pistons in reciprocation, and each said cylinder bore has a cross-section formed of any closed curve other than a circle, wherein the closed curve comprises a plurality of curve elements and a plurality of straight elements, and each of the straight elements connects each two adjacent curve elements, wherein each of the pistons comprises:

a piston body having an inner end disposed within the cylinder bore;

a piston head mounted on the inner end of the piston body; and a piston ring mounted on the piston body, wherein the piston head and the piston ring have a cross-sectional shape which conforms to the cross-section of the cylinder bore, such that only the piston head and the piston ring slidably contact the cylinder bore when the piston is fitted in the cylinder bore, wherein the piston head and the piston ring each comprise:

a metallic ring portion surrounding the outer periphery of the piston body; and a seal ring surrounding an outer periphery of the ring portion, the seal ring being formed of a synthetic resin and being elastically deformable.

2. The compressor according to claim 1, wherein said closed curve is triangular and includes a first curve element defining a base extending in a rotating direction of said swash plate and a second curve element defining a top directed inward in a diametrical direction of said swash plate and having a curvature radius smaller than that of the first curve element.

3. The compressor according to claim 2, wherein said closed curve further includes third curve elements connecting with ends of the first curve element and having a curvature radius smaller than that of the second curve element, the straight elements connecting the corresponding third curve element and the second curve element, respectively.

4. The compressor according to claim 1, wherein said closed curve is oval and includes a first curve element defining a large end portion situated ahead as viewed in a rotating direction of said swash plate, a second curve element defining a small end portion situated behind as viewed in the rotating direction and having a curvature radius smaller than that of the first curve element, and two straight elements connecting the first and second curve elements.

5. The compressor according to claim 1, wherein said compression unit includes a cylindrical outer shell, a metallic center sleeve located in a center of the outer shell and supporting said main shaft by means of a bearing, metallic intermediate sleeves arranged between the outer shell and the center sleeve and individually defining said cylinder bores inside, and a resin filler filling gaps in the outer shell.

6. The compressor according to claim 5, wherein said cylinder bores are formed by plastically deforming the intermediate sleeves.

7. The compressor according to claim 1, wherein said piston body is a hollow structure opening at the inner end thereof, and said piston head has a cap portion closing the inner end and a rim connecting with the cap portion and serving as the ring portion.

8. The compressor according to claim 1, wherein said ring portion has a slit extending in an axial direction of said piston and crossing the ring portion.

9. The compressor according to claim 8, wherein said seal ring has an outer slit extending in the axial direction of the piston and crossing the seal ring, the outer slit forming one passage in conjunction with the inner slit of the ring portion.

10. The compressor according to claim 1, wherein said seal ring has at least one circumferential groove on an outer peripheral surface thereof.

11. A swash plate compressor, comprising:

a housing;

a rotatable main shaft extending in the housing;

a swash plate mounted on the shaft and rotatable together with the shaft; and a compressor unit adapted to carry out a suction process and a compression process for a working fluid as the swash plate rotates, wherein the compressor unit comprises:

a plurality of pistons arranged adjacent to one another in the rotating direction of the swash plate and adapted to reciprocate in an axial direction of the shaft as the swash plate rotates;

a plurality of cylinder bores, wherein each of the cylinder bores is configured to receive a corresponding one of the pistons and to guide the corresponding one of the pistons in reciprocation, and each said cylinder bore has a cross-section formed of any closed curve other than a circle, wherein the closed curve comprises a plurality of curve elements and a plurality of straight elements, and each of the straight elements connects each two adjacent curve elements;

a cylindrical, hollow outer shell;

a metallic center sleeve located in a center of the outer shell and supporting the main shaft by means of a bearing;

metallic intermediate sleeves arranged between the outer shell and the center sleeve and individually defining the cylinder bores therein to form gaps within the outer shell outside of the intermediate and center sleeves; and a resin filler filling the gaps.

12. The compressor according to claim 11, wherein the metallic intermediate sleeves are disposed in a state contacting an inner circumferential surface of the cylindrical outer shell and an outer circumferential surface of the metallic center sleeve.

13. The compressor according to claim 12, wherein in the metallic intermediate sleeves, each two sleeves adjacently disposed in a circumferential direction of the cylindrical outer shell are in contact with each other.

* * * * *